US007000624B2

(12) United States Patent
Chang

(10) Patent No.: US 7,000,624 B2
(45) Date of Patent: Feb. 21, 2006

(54) UMBRELLA HAVING SOLAR POWERED ILLUMINATION STRUCTURE

(76) Inventor: Tony Wei-Sin Chang, 1416 Johnson Ave., San Jose, CA (US) 95129

( * ) Notice: Subject to any disclaimer, the term of this patent is extended or adjusted under 35 U.S.C. 154(b) by 240 days.

(21) Appl. No.: 10/728,501

(22) Filed: Dec. 5, 2003

(65) Prior Publication Data

US 2005/0121063 A1 Jun. 9, 2005

(51) Int. Cl.
*A45B 3/02* (2006.01)

(52) U.S. Cl. ..... 135/16; 135/98; 135/910; 362/102; 362/555

(58) Field of Classification Search ..... 135/15.1, 135/16, 98, 31, 910; 362/102, 184, 234, 362/555, 559; 428/8–9
See application file for complete search history.

(56) References Cited

U.S. PATENT DOCUMENTS 5,584,564 A * 12/1996 Phyle ..... 362/102
6,089,727 A * 7/2000 Wu ..... 362/102
6,386,214 B1 * 5/2002 Clarke ..... 135/20.3
6,439,249 B1 8/2002 Pan et al.
6,598,990 B1 * 7/2003 Li ..... 362/102
6,612,713 B1 * 9/2003 Kuelbs ..... 362/102
6,666,224 B1 * 12/2003 Lee ..... 135/16
6,820,995 B1 * 11/2004 Lin ..... 362/102
6,837,255 B1 * 1/2005 Bunch et al. ..... 135/16
6,840,658 B1 * 1/2005 Anderson et al. ..... 362/367
2002/0074027 A1 6/2002 Maidment

* cited by examiner

*Primary Examiner*—Winnie Yip

(57) ABSTRACT

A lighted umbrella comprises a solar power device mounted on the top end of the shaft of the umbrella. A plurality of ribs is pivotally connected to the shaft. Each rib has a hollow interior in which an electrical wire can be stored. A slot is formed on each rib to accommodate two transparent light guiding rods that are disposed on the slot to form an opening space near the middle of the rib. A plurality of lighting devices is affixed on the rods through the opening space. Energy efficient devices such as light emitting diodes are used as the lighting devices to save energy provided by the solar power device. A fabric supported by the ribs forms the shelter for the umbrella.

11 Claims, 5 Drawing Sheets

UMBRELLA HAVING SOLAR POWERED ILLUMINATION STRUCTURE

FIELD OF THE INVENTION

The present invention relates to a lighted umbrella, and more specifically to an umbrella having illumination structure powered by a solar power device.

BACKGROUND OF THE INVENTION

Umbrellas have served many purposes for human. Some small umbrellas are light and easily carried by people and some large umbrellas are heavier and usually installed in the patio or near the beach. They can be used to shelter from the rain or sunlight. Lighted umbrellas have also been designed to provide illumination for the convenience of night activities or serving as outdoor decoration.

Lighted umbrellas powered by solar energy have become very popular in recent years because it does not require a power outlet or an extension cord to get the electrical power supply. In general, a solar power device having rechargeable batteries and solar cells are assembled on the top end of a shaft above the umbrella. Lighting devices mounted on the umbrella are powered by the solar power device. During the daytime, sun light provides the solar energy to charge the batteries for powering the lighting devices in the night.

There are a couple of shortcomings in the conventional lighted umbrella powered by solar energy. One is that the lighting devices usually take a lot of power which quickly drains out the charge in the batteries and hence the illumination only last a short period time. The other is that the lighting devices form very strong localized bright areas that are blinding to people.

SUMMARY OF THE INVENTION

The present invention has been made to overcome the above mentioned shortcomings of the conventional lighted umbrella. An object of the invention is to provide an illumination structure for the lighted umbrella that can provide uniform and pleasant light. Another object is to provide an illumination structure that can last for a long time with solar power.

According to this invention, the lighted umbrella powered by a solar power device comprises a frame with illumination structure. The frame includes a shaft, a plurality of ribs pivotally connected to the shaft, and a plurality of supporting bars each having one end pivotally connected to a movable connector received on the shaft and the other end pivotally connected to a rib. A solar power device is mounted on the top end of the shaft of the umbrella. Each rib has a hollow interior in which an electrical wire can be stored. A slot is formed on each rib to accommodate two transparent elongated light guiding rods that are disposed on the slot to form an opening space near the middle of the rib.

The hollow interior of each rib has an electrical wire that has one end connected to the solar power device and the other end connected with two light emitting diodes each being mounted on a respective transparent elongated rod through the opening space near the middle of the rib. Energy efficient devices such as light emitting diodes are used as the lighting devices to save energy provided by the solar power device. The transparent elongated rods guide the emitted light to increase the lighting area and form uniform and pleasant light.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
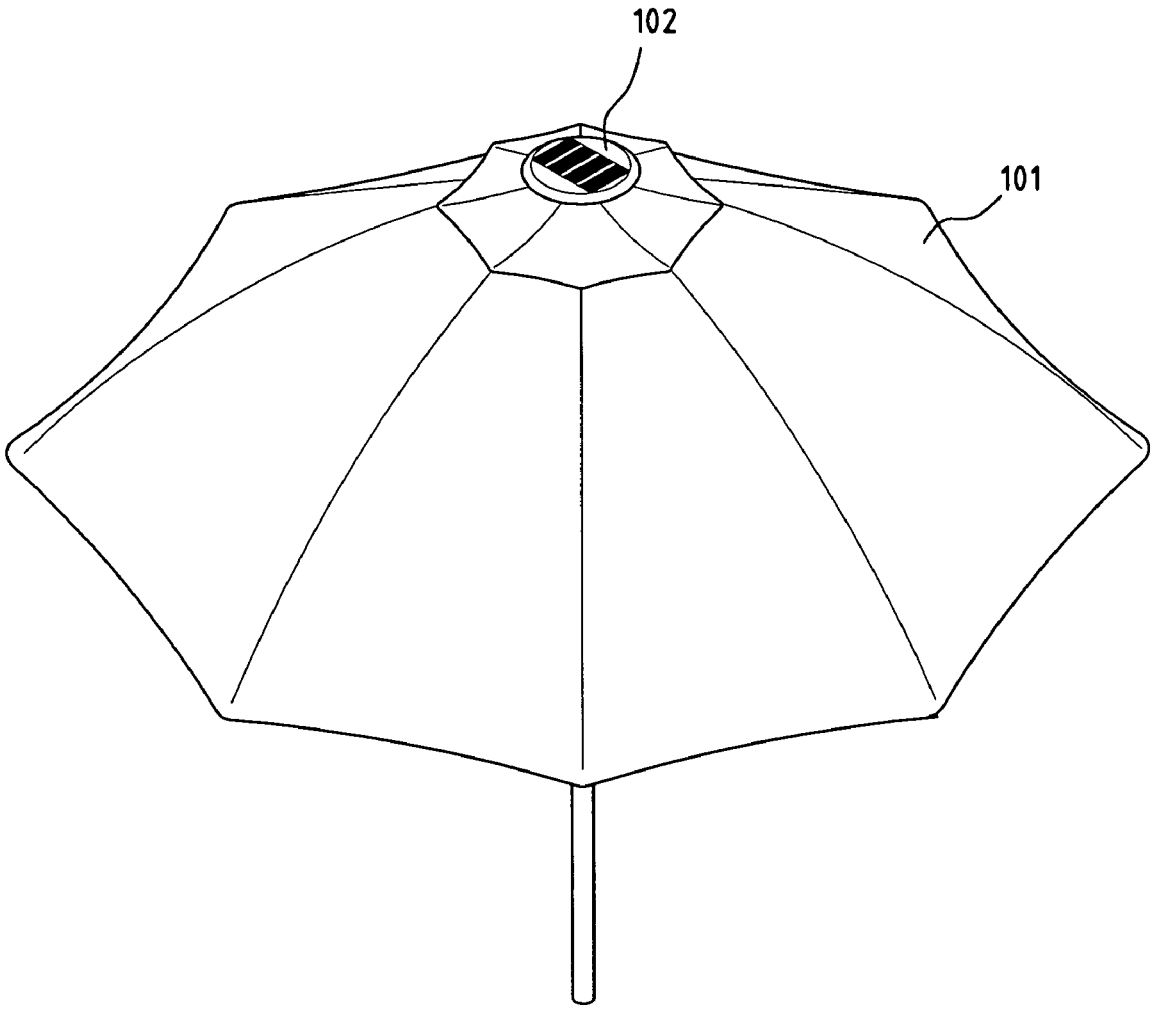
FIG. 1 shows an umbrella having solar powered illumination structure according to this invention.
Figure 2:
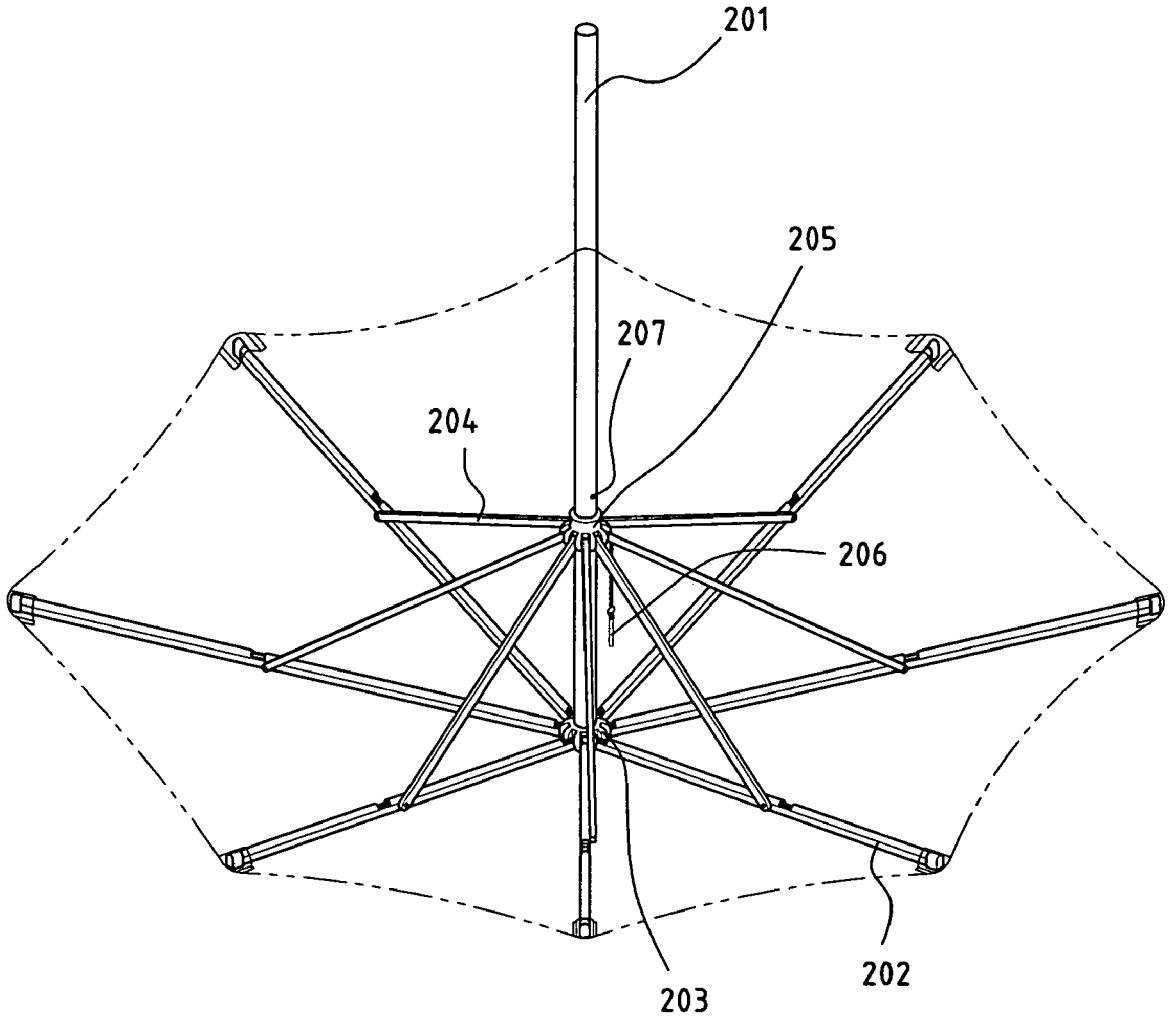
FIG. 2 shows the interior view of the umbrella.

With reference to FIG. 1 of the drawings, a preferred embodiment of the umbrella having solar powered illumination arrangement of the present invention comprises a frame for supporting a fabric 101 thereon. A solar power device 102 is mounted to the top center of the frame through the fabric. FIG. 2 illustrates the interior view of the umbrella.

As shown in FIG. 2, the frame comprises a plurality of ribs 202 pivotally connected to a shaft 201 by means of a first connector 203. The ribs 202 extend radially from the first connector 203 that is affixed to the top end of the shaft 201. Each rib 202 has a supporting bar 204 with one end pivotally connected to the rib 202. The other end of the supporting bar 204 is pivotally connected to a second connector 205. The second connector 205 has a circular opening in the center for the shaft 201 to pass through and is movable along the shaft 201. The supporting bars 204 extend radially and outwardly from the second connector 205.

A pin 206 is chained to the second connector 205. The shaft 201 has at least one through hole 207 formed thereon. When the umbrella is opened, the second connector 205 and the supporting bars 204 can be moved up or down to a desirable position. The pin 206 can be inserted into an appropriate through hole 207 so as to fix the second connector 205 and maintain the frame in an opened state. The umbrella can also be folded by removing the pin and moving down the second connector 205.

Figure 3:
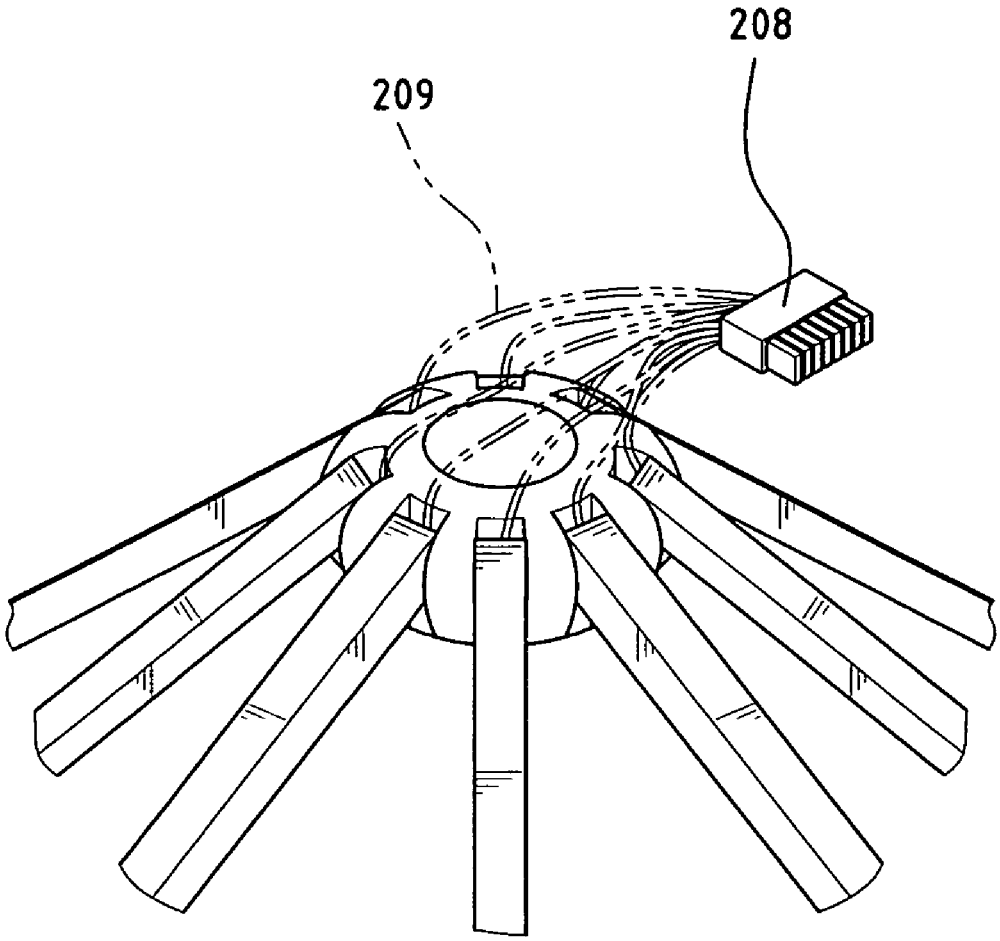
FIG. 3 shows the top portion of the frame and an electrical connector for connecting lighting devices to a solar power device.

The solar power device 102 is mounted onto the top enter of the shaft 201 by a device such as a matched screw and a screw hole. A plurality of electrical wires 209 are connected to the solar power device 102 by an electrical connector 208 as shown in FIG. 3. Each rib 202 has a hollow interior along the elongated direction. Each electrical wire 209 passes through and is stored in the hollow interior of a rib 202. At least two lighting devices 305 are connected to the electrical wire 209 at the end as shown in FIG. 4.

Figure 4:
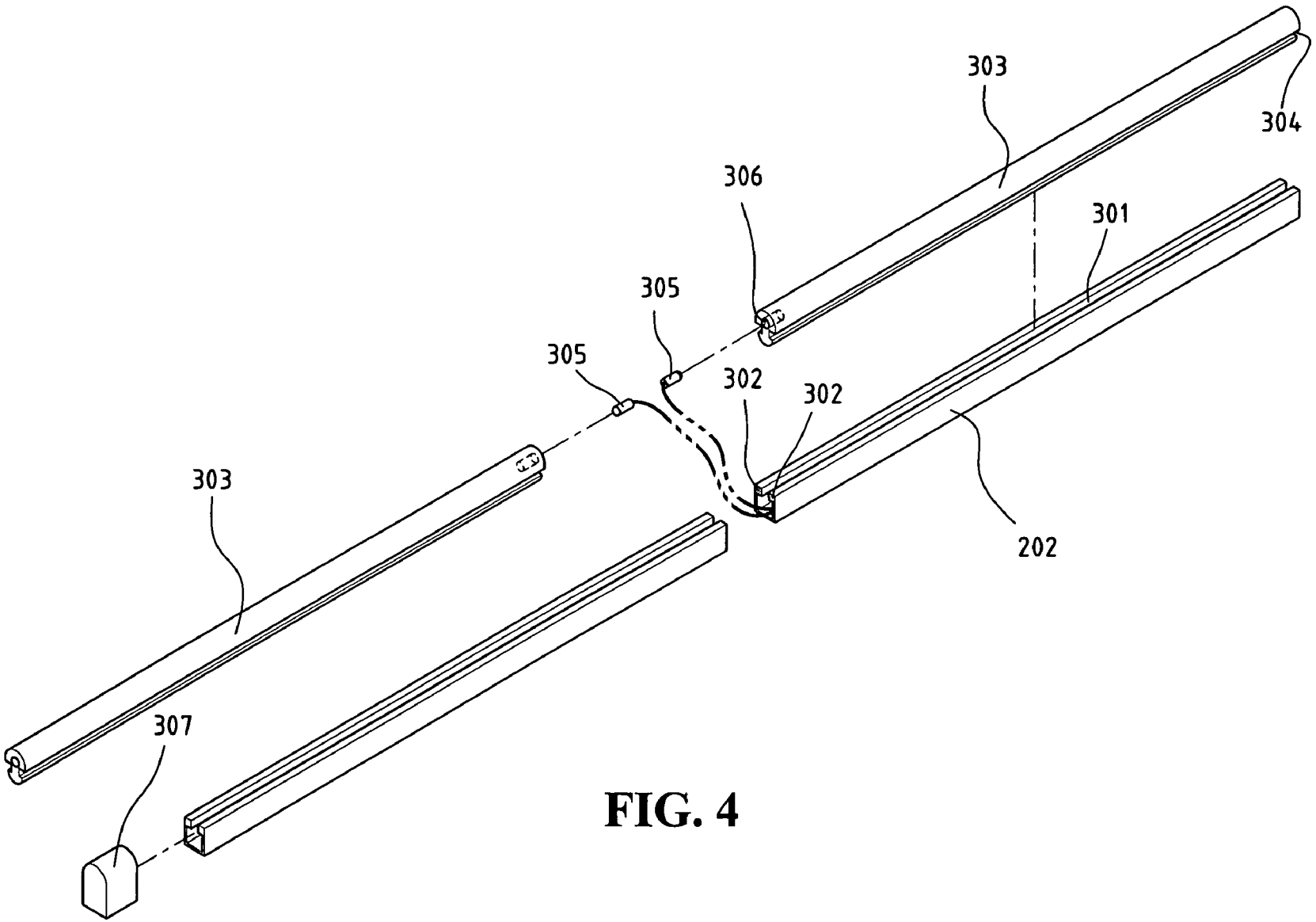
FIG. 4 shows the cut-off and decomposed view of a rib of the umbrella.

With reference to a cut-off and decomposed view of a rib illustrated in FIG. 4, a slot 301 is formed on each rib 202. Two elongated edge pieces 302 are formed on the two sides of the slot 301. At least two elongated rods 303 are installed on each rib 202. The upper part of an elongated rod 303 is substantially semi-cylindrical and the lower part is formed with two elongated slits 304 that are engageable with the two elongated edge pieces 302 of the rib 202 on the two sides. The two elongated rods 303 meet near the middle of the rib 202 with an opening space between them. The lighting devices 305 connected with the electrical wire are inserted into holes 306 formed on the elongated rods 303. FIG. 4 shows that the elongated rod 303 has one end formed with a hole 306 for receiving a lighting device 305.

Figure 5:
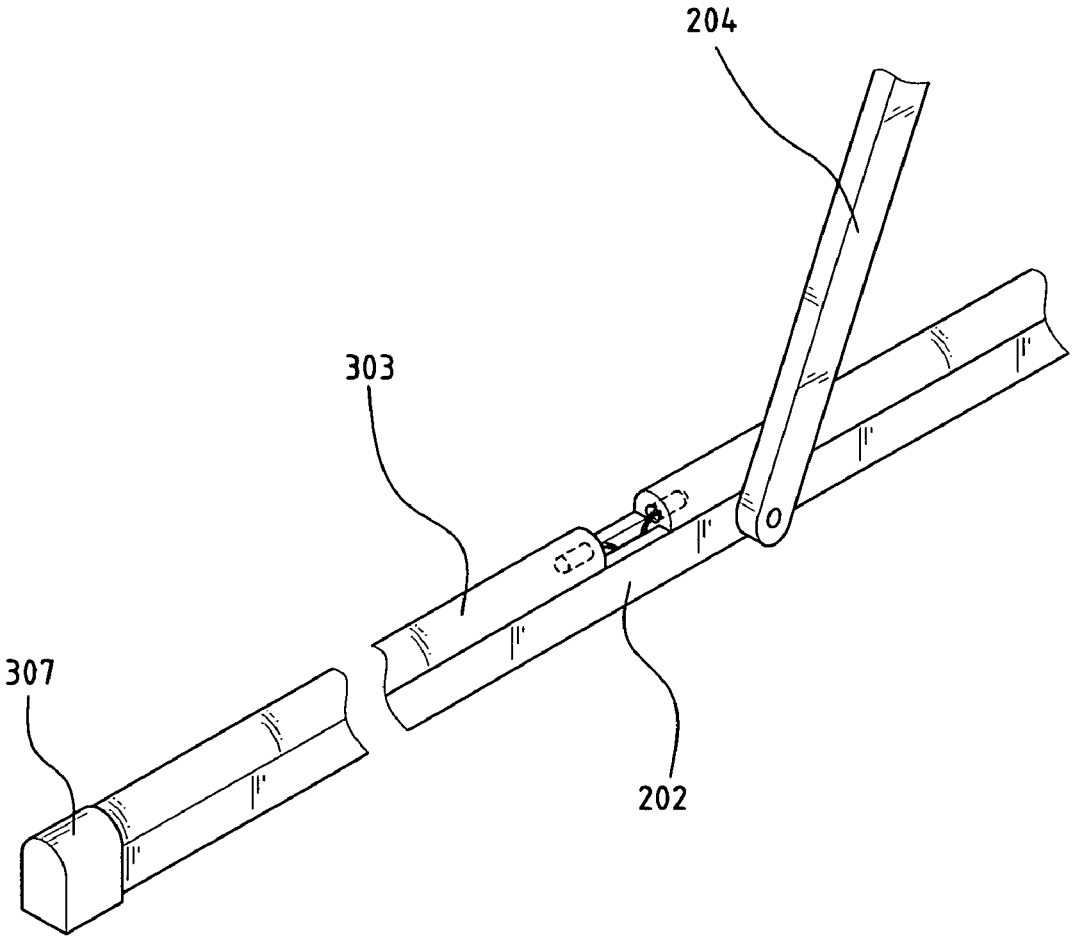
FIG. 5 shows the lighting devices and the elongated rods assembled on a rib on which a supporting bar is pivotally connected.

According to this invention, the preferred material for forming the rib 202 is an alloy such as aluminum. The rib 202 may have a rectangular cross section as shown in FIG. 4. A circular tube may also be used. Because of the hollow interior required to form the rib, aluminum or other light weight strong material is preferred although strong wood material may also be used. FIG. 5 shows the lighting devices and the elongated rods assembled on a rib on which a supporting bar is pivotally connected. A cap 307 is used to cover the end of the rib 202.

The preferred material for forming the elongated rod 303 is acrylic-plastic. The elongated rod 303 also serves as a light guiding device for guiding the light emitted by the lighting device 305 along the rod to extend the lighting area. In this invention, the acrylic-plastic material is transparent, dispersive and diffusive to light so that uniform and pleasant light is created.

In the conventional lighted umbrella, either light bulbs or light emitting diodes have been used. Both are applicable to the lighting devices of this invention. However, light emitting diodes are preferred. The light guiding rod 303 of this invention has the advantage that the lighting area is greatly extended from the small light emitting diode by means of the transparent, dispersive and diffusive elongated rod. Therefore, two light emitting diodes are often adequate for the lighted umbrella. As a result, the rechargeable batteries which are contained in the solar power device can supply the power to the light emitting diodes for a longer period.

Although only two elongated rods and two light emitting diodes are illustrated in the preferred embodiment, more elongated rods and more light emitting diodes can be installed on each rib if desired. An opening space can be created where every two elongated rods meet for accommodating the lighting devices and the electrical wire.

Although only the preferred embodiments of this invention were shown and described in the above description, various modification or combination that comes within the spirit of this invention may also be made by a person skilled in the field according to the principle described.

What is claimed is:

1. An umbrella having a frame for supporting a fabric thereon, said frame comprising:

a shaft;

a plurality of ribs radially and pivotally connected to said shaft by a first connector, each rib having at least two elongated transparent rods mounted on said rib with an opening space formed between said two elongated transparent rods, and an electrical wire having a first end connected to a power supply and a second end connected with at least two lighting devices affixed to said at least two elongated transparent rods through said opening space; and a plurality of supporting bars each having a first end pivotally connected to a respective rib and a second end pivotally connected to a second connector, said second connector having a center hole for encircling and movably sliding along said shaft.

2. The umbrella as claimed in claim 1, wherein said power supply is a solar power device mounted on a top end of said shaft.

3. The umbrella as claimed in claim 1, wherein each rib further has an elongated slot between two elongated edge pieces, and each elongated transparent rod has two elongated slits for engaging with said two elongated edge pieces.

4. The umbrella as claimed in claim 1, wherein said rib has a hollow interior and said electrical wire is stored in said hollow interior.

5. The umbrella as claimed in claim 1, wherein each elongated transparent rod has a hole formed near said opening space for receiving one of said lighting devices.

6. The umbrella as claimed in claim 1, further comprising a pin tied to said second connector and at least one through hole formed on said shaft for receiving said pin.

7. The umbrella as claimed in claim 1, wherein said lighting devices are light emitting diodes.

8. The umbrella as claimed in claim 1, wherein said elongated transparent rods are made of acrylic-plastic material.

9. The umbrella as claimed in claim 1, wherein said elongated transparent rods are diffusive to light.

10. The umbrella as claimed in claim 1, wherein said elongated transparent rods are dispersive to light.

11. The umbrella as claimed in claim 1, wherein said ribs are made of aluminum.

* * * * *